United States Patent [19]

Wolgamot et al.

[11] 3,984,939

[45] Oct. 12, 1976

[54] TOY AUTOMOBILE

[75] Inventors: Chet Wolgamot; Harvey G. Springer, both of Cincinnati, Ohio

[73] Assignee: General Mills Fun Group, Inc., Minneapolis, Minn.

[22] Filed: Sept. 11, 1975

[21] Appl. No.: 612,423

[52] U.S. Cl. ..... 46/202; 46/209; 46/211

[51] Int. Cl.[2] ..... A63H 11/12; A63H 29/10

[58] Field of Search ..... 46/201, 202, 97, 101, 46/106, 206, 209

[56] References Cited

UNITED STATES PATENTS

| | | | |
|---|---|---|---|
| 3,574,267 | 4/1971 | Schorsch | 46/211 |
| 3,701,216 | 10/1972 | Smith | 46/209 |

FOREIGN PATENTS OR APPLICATIONS

| | | | |
|---|---|---|---|
| 1,012,223 | 7/1957 | Germany | 46/209 |

*Primary Examiner*—Louis G. Mancene
*Assistant Examiner*—Robert F. Cutting
*Attorney, Agent, or Firm*—James M. Kipling

[57] ABSTRACT

A toy automobile comprises a body supported by a drive wheel capable of storing kinetic energy and engaging a surface to propel the body linearly thereon in the direction of motion of the rotating drive wheel. The toy automobile includes a retractable skid inducing wheel supported by a pivotable bracket which, in one position thereof, engages the surface and deflects motion of the body from its linear direction. The skid inducing wheel is retractable into a position wherein it does not engage the surface and does not interfere with the direction of motion of the body. A spring biassed actuator is provided for moving the skid inducing wheel between its retracted and extended positions; and a releasable latch is provided for securing the skid inducing wheel in its retracted position. The latch is adapted to cooperate with a toy figure carried by the toy automobile.

13 Claims, 13 Drawing Figures

46
32
20
148
28
152
153
22
64
11
3
24
26
184
29
30
72
70
62
34
144
146
180
44
40
38
42

Fig 7
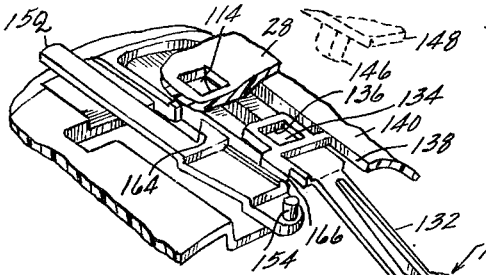
Fig 10
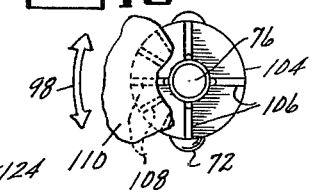
Fig 9
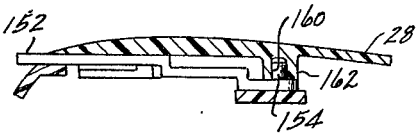
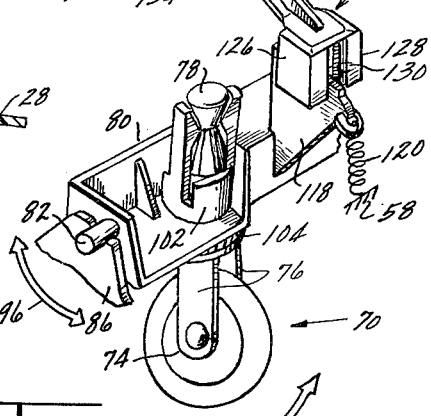
Fig 6
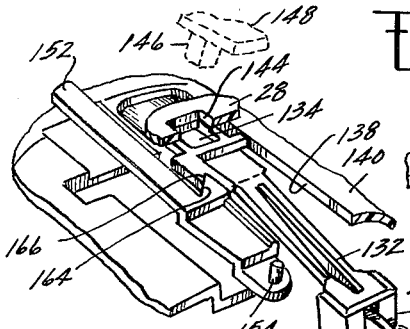
Fig 8
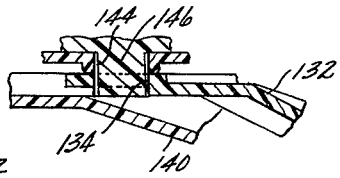
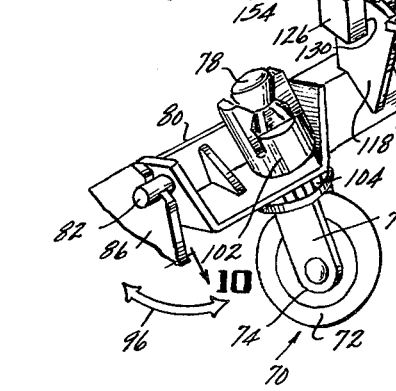
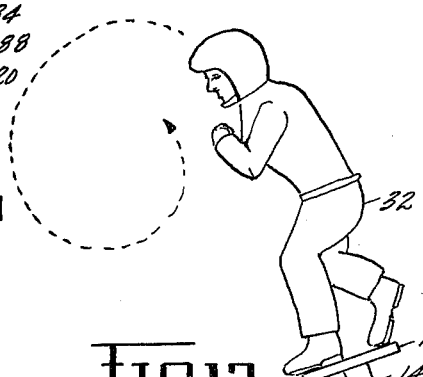
Fig 13
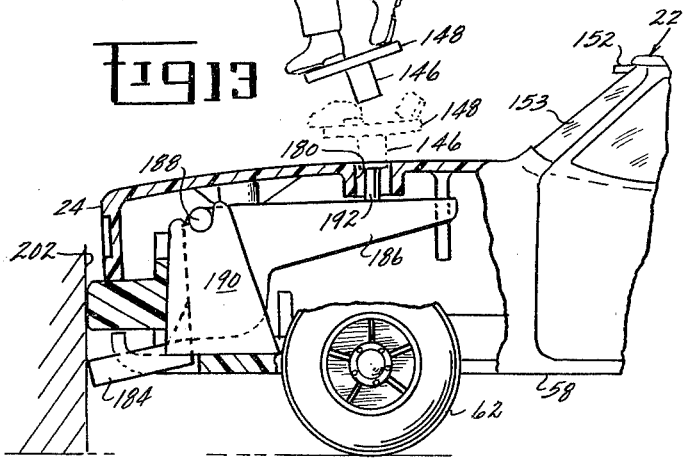

TOY AUTOMOBILE

BACKGROUND AND SUMMARY OF THE INVENTION

The present invention pertains to toy automobiles and particularly toy automobiles adapted to simulate a skidding action.

Since their inception, toy automobiles have greatly appealed to children. This is particularly true with respect to those types of toy automobiles which have capability of propelling themselves across a surface. One type of self propelled toy automobile includes a single rotatable drive wheel of substantial mass for supporting the body of the toy automobile and storing, through high speed rotation, a quantity of kinetic energy which can be transferred to the surface in order to propel the vehicle thereacross. An example of this type of toy vehicle is disclosed in U.S. Pat. No. 3,621,607.

In order to increase the excitement and entertainment value of toy automobiles, many modifications of such automobiles have been provided which modifications are capable of demonstrating unique operating characteristics. At the same time, children of all ages have been fascinated by automobile stunt shows in which experienced drivers perform tricks with automobiles. Two tricks of particular interest include causing the automobile to go into a skid or power slide, and carrying a rider who is catapulted from the vehicle in various manners.

It is therefore an objective of the present invention to provide a toy vehicle of the character described having a self propelled capability with a selectively operable skid inducing mechanism.

It is a further objective of the present invention to provide a toy automobile which has the capability of carrying a toy figure and catapulting that figure from the automobile upon the occurence of some selected event.

Briefly, one embodiment of the invention includes a toy automobile body, a rotatable drive wheel mounted upon the body in an orientation such that the drive wheel, upon rotation, will propel the body in a substantially forward direction along the longitudinal axis of the body. The drive wheel includes a pinion affixed to a shaft carried at the axis of the drive wheel for engagement by a toothed strip or flexible rack which can be drawn rapidly thereacross in order to impart a rapid rotational motion to the drive wheel.

A second rotation wheel is carried by a retractable skid inducing means moveable between a first position wherein the wheel is remote from the surface and a second position wherein the wheel engages the surface and deflects the motion of the body away from the longitudinal axis of the body. The skid inducing means includes a spring biassed actuator means for moving the second wheel towards its surface engaging position and a latch for preventing actuation of the actuator. A toy figure is provided for cooperation with the latch in order to retard the actuator, the removal of the toy figure from the body operating to release the latch and permit the actuator to operate.

A second facet of the invention provides a bumper, an aperture for carrying the toy figure on the automobile body, an ejector for propelling the toy figure away from the body when the bumper engages an external object, and a linkage between the bumper and ejector for facilitating its operation.

Other objects, features and advantages of the present invention will become apparent through a perusal of the following detailed description taken in conjunction with the accompanying drawings.

BRIEF DESCRIPTION OF THE DRAWINGS

FIG. 6 is a perspective view of one portion of the toy automobile of the present invention and depicting the skid inducing elements thereof;

FIG. 7 is a perspective view of the elements depicted in FIG. 6 and shown in a modified operating relationship;

FIG. 8 is a section view of a portion of the skid inducing means of FIG. 6 and illustratiang its cooperation with a toy figure;

FIG. 9 is a section view of the skid inducing means of FIG. 6 and illustrating a manual disabler;

FIG. 10 is a section view of a portion of the toy automobile of the present invention taken along line 10—10 of FIG. 6;

FIG. 11 is a section view of a toy automobile of the present invention taken along line 11—11 of FIG. 1; and FIG. 12 is a section view of a portion of the toy automobile of the present invention taken along line 12—12 of FIG. 4.

FIg. 13 is a sectional view of a portion of the toy vehicle of FIG. 1 showing operation of means for ejecting the toy figure from the front portion thereof.

DESCRIPTION OF A PREFERRED EMBODIMENT

Figures 1, 2:
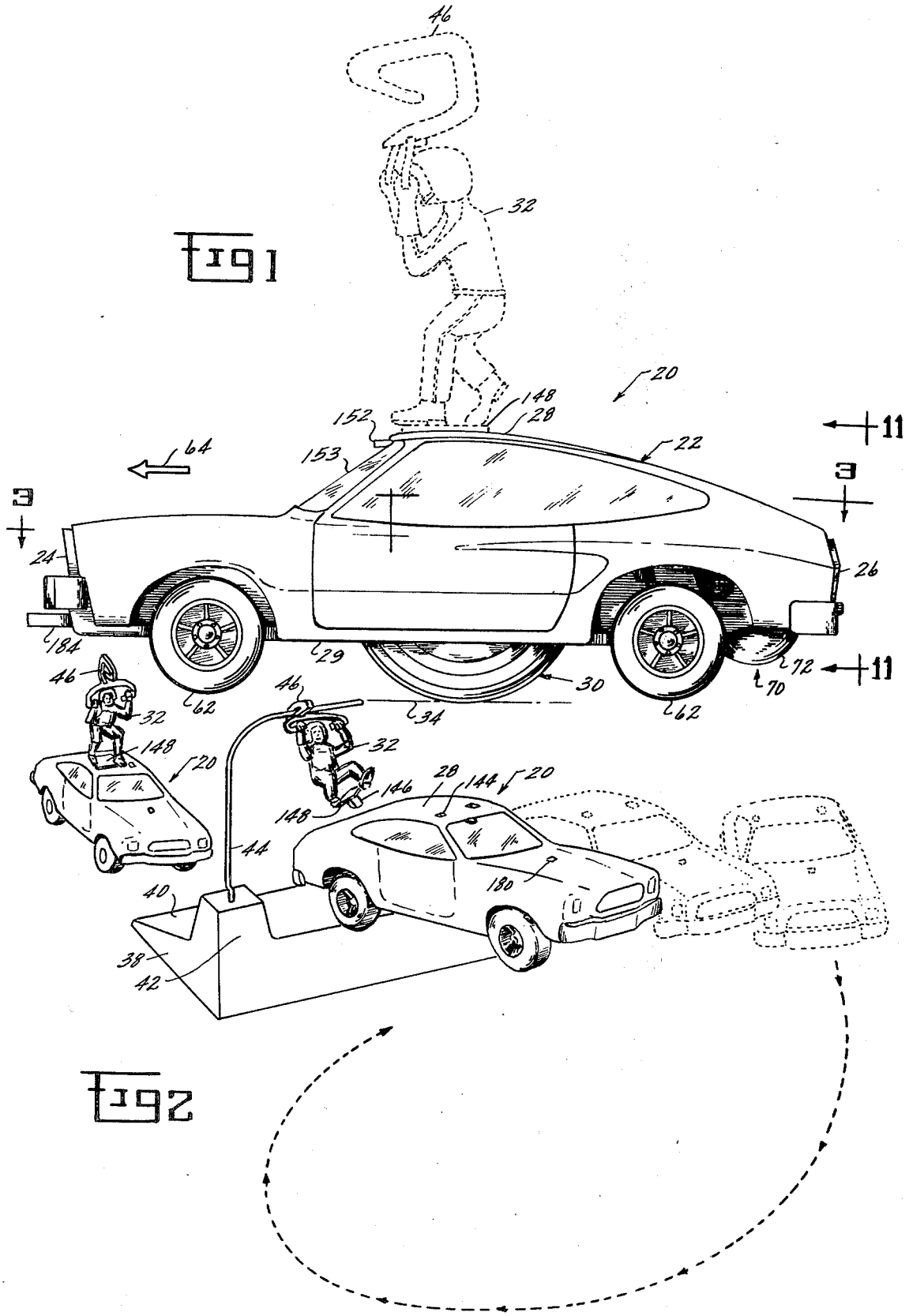
FIG. 1 is a frontal elevation view of the toy vehicle of the present invention carrying a toy figure and embodying the concepts of the present invention.
FIG. 2 is a perspective view of the toy automobile and figure of the present invention illustrating its use with an accessory toy ramp jump and further illustrating one mode of operation of the toy automobile.

Referring to FIG. 1 a substantial portion of the present invention is depicted. The toy automobile designated generally by the numeral 20 includes a body 22 having a front 24, a rear 26, a top 28, and a bottom 29. The body is supported and propelled, in a manner to be described hereinafter, by a drive wheel 30 and is adapted to carry a toy figure 32. The toy automobile can be propelled along a surface 34 by means of the drive wheel 30.

FIG. 2 illustrates one mode of operation of the toy automobile of the present invention when it is used in combination with accessory elements. One of these accessory elements is a jump ramp 38 which includes an inclined, generally flat surface 40 raised at one end to cause the toy automobile 20 to become airborne after traversing the surface. The jump ramp includes a boss 42 which supports an overhead rail 44, in the general form of a wicket, which is adapted to be engaged by and cooperate with a hook element 46 carried by the toy figure. FIG. 2 illustrates a mode of operation of the toy automobile as it passes over ramp 38 beneath the rail 44 and into a skid as described hereinafter.

Figures 1, 2, 3:
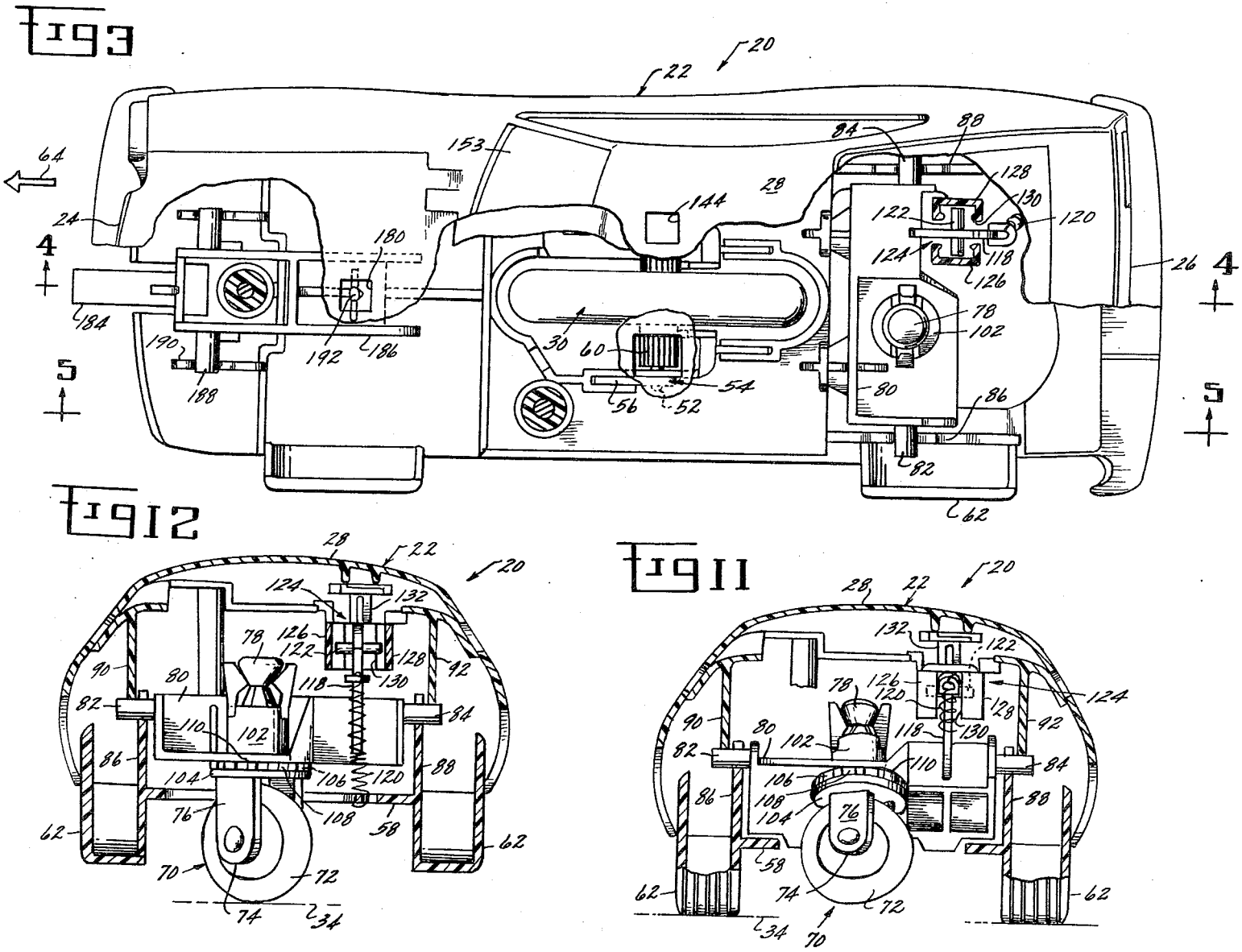
FIG. 3 is a partial section view of the toy automobile of FIG. 1 taken along the line 3—3.
Figure 5:
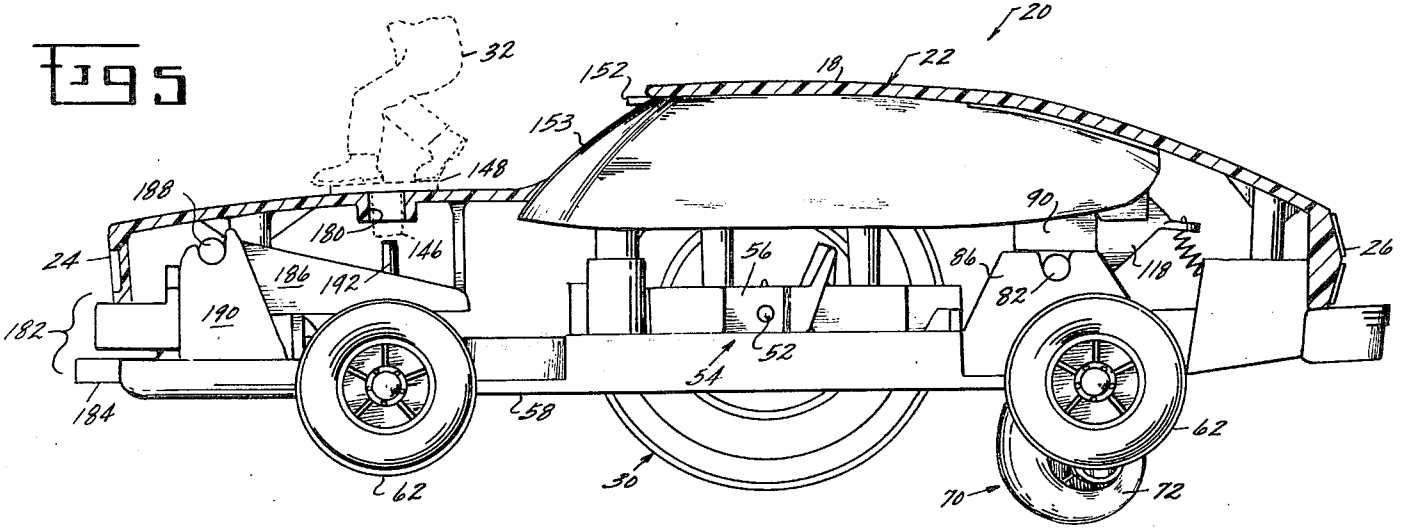
FIG. 5 is a section view of the toy automobile taken along line 5—5 of FIG. 3.
Figure 4:
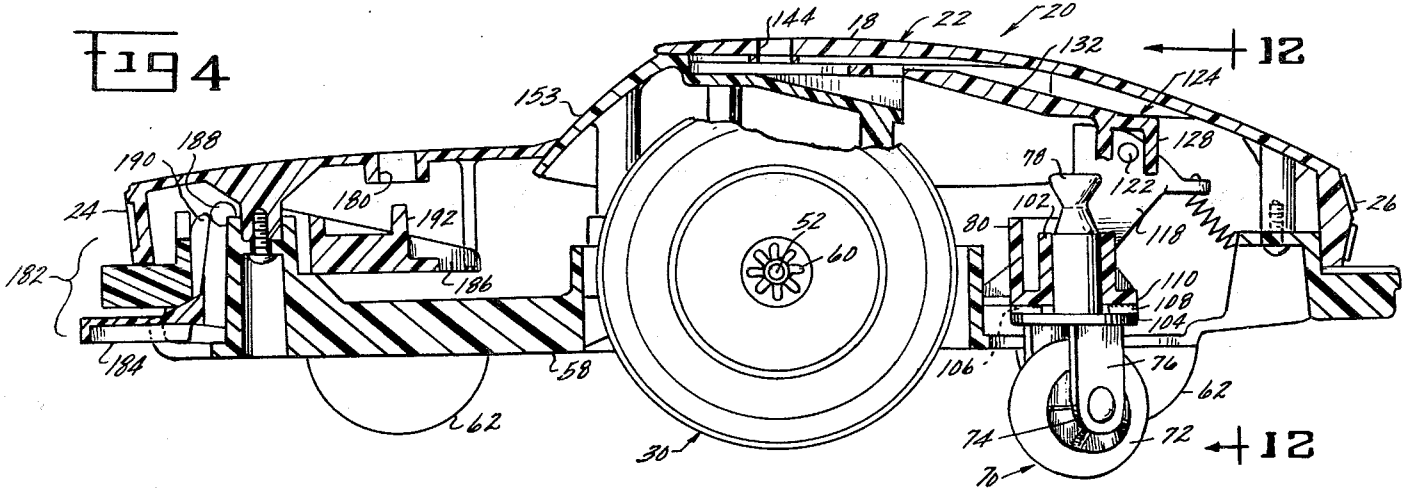
FIG. 4 is a cross section of the toy automobile taken alone line 4—4 of FIG. 3.

Referring now to FIGS. 3, 4 and 5, the relationship between the drive wheel 30 and the body 22 can be understood. The drive wheel is shown to be mounted at its axis upon a shaft 52 which is supported within the body by a means of a journal bearing 54 supported by a shoulder 56 which comprises a part of a chassis 58 which forms the lower portion of the toy automobile. Shaft 52 is freely rotatable within bearing 54 so that the drive wheel 30 may be rotated about this shaft. In order to facilitate the rotation of the drive wheel, a pinion gear 60 is affixed to the wheel about the shaft 52 so that rotation of the pinion gear results in rotation of the drive wheel 30. A toothed gear strip or flexible rack may be provided with the toy automobile for engagement with pinion 60. The gear strip (not shown) can be drawn across the pinion rapidly in order to impart rotational velocity to the drive wheel 30. The drive wheel itself is preferably constructed of a relatively heavy material so that its rotation results in the generation and storage of substantial quantities of kinetic energy.

As depicted in FIG. 1, the drive wheel 30 extends slightly farther below the bottom 29 of the body 22 than do four skids 62 having the general appearance of wheels. Skids 62 may have rotational capabilities but this is not necessary since the majority of the weight of the toy automobile is supported by drive wheel 30. In the mode of operation depicted in FIG. 1, rotation of the drive wheel 30 upon surface 34 would impart to the body 22 a linear motion in the direction of arrow 64 (see also FIG. 3) which is generally longitudinal with respect to the body 22. Based upon the gyroscopic effect of the rapidly rotating drive wheel 30, the body 22 will tend to continue to move in the direction of the arrow 64 along a linear path unless some substantial force deflects it from that direction.

As has been stated previously, of particular interest to children who play with toy automobiles are simulated stunts and crash sequences. The present invention provides operating means for simulating stunts and crashes as well as skids. FIGS. 4 through 12 illustrate one embodiment of a skid inducing means and shows the operating relationships between the various elements thereof. The elements of the skid inducing means are shown in isolation from the remaining parts of the toy automobile in FIGS. 7 through 10. In these Figures, a portion of the top 28 or roof of the car is depicted showing the spatial relationship of the depicted elements to the body of the car, the majority of which is now shown.

The skid inducing means is designated generally by the numeral 70 and includes a rotatable wheel 72 suitable for engaging the surface 34 upon which the drive wheel rides. The wheel 72 is journalled near one end 74 of a bracket 76 having a generally elongated shape, the other end 78 of which cooperates with a carriage 80 by which the bracket and wheel are supported. By virtue of a pair of pivot pins 82 and 84 disposed at each of the lateral sides of the carriage 80, the carriage is supported with respect to the body of the toy automobile. As best shown in FIGS. 11 and 12, the pivot pins 82 and 84 are captured between flanges 86 and 88 carried by the chassis 58 (see FIG. 5 for position) and a pair of opposed flanges 90 and 92 carried by the body 22. By means not shown the chassis 58 and body 22 are held together so that the chassis effectively becomes a part of the body 22 and the pins are secured. The pivot pins 82 and 84 permit the carriage to pivot through a predetermined arc as indicated by comparison of FIGS. 6 and 7 and FIGS. 11 and 12, and as illustrated by directional arrow 96.

Wheel 72 and its supporting bracket 76 are additionally pivotable in the direction of arrow 98 in FIG. 7 by virtue of rotatable engagement between a circular portion of the bracket and an aperture in the carriage 80 surrounded by a generally cylindrical boss 102. At a point intermediate the ends 74 and 78 of bracket 76, a generally disc shaped flange 104 is disposed in an orientation generally perpendicular to the longitudinal axis of the bracket. As shown in FIG. 10, disc 104 carries plurality of upstanding ribs 106 which are suitable for cooperating with an opposed plurality of indentations 108 included in a mating flange 110 carried beneath carriage 80. By virtue of the mating ribs 106 and 108, wheel 72 can be positioned in any of a discreet number of angular orientations with respect to carriage 80, and consequently with respect to the drive wheel 30. The wheel 72 is retained within any preselected angugular orientation by means of a spring (not shown) urging the mating ribs and indentations together.

The length of the bracket 76, the radius of the wheel 72 and the disposition of the bracket and carriage with respect to the chassis 58 are such that, in the position shown in FIGS. 1, 6 and 11, wheel 72 is in a retracted position, wherein it is withdrawn from engagement with surface 34. FIGS. 4, 5, 7 and 12 depict the wheel in a projected position wherein wheel 72 engages surface 34. As will be seen, this engagement can cause a deflection from motion of the toy automobile body 22 from the direction 64 and can result in the appearance of skidding of the toy automobile.

Referring now to FIGS. 4 through 11, elements of the apparatus for accomplishing retraction and projection of the wheel 72 will be described. The carriage 80 includes an integrally formed flange or shoulder 118 which projects generally radially outward from the axis of rotation of the carriage about pivot pins 82 and 84. To this flange is attached a tension spring 120 stretched between the flange and a portion of the chassis 58. The tension spring biasses the carriage toward its projected position.

The present invention also provides means for restraining the carriage 80 against rotation in the direction urged by spring 120, as well as for moving the carriage against the spring in order to move wheel 72 into its retracted position. More particularly, referring to FIGS. 4 and 12, it can be seen that flange 118 includes a transverse pin 122 intergrally formed with the flange and projecting generally perpendicularly with respect thereto in both lateral directions from the flange. The pin 122 is captively held within a slotted clamp 124 (FIGS. 6 and 7) formed of a pair of opposed shoulders 126 and 128 separated by a slot 130. This pin and slotted clamp arrangement permits the clamp 124 to move in a "rolling" action tangentially with respect to the flange 118 and carriage 80 and maintain an operative engagement therewith.

In order to operate the carriage (through the cooperation of the clamp 124 and flange 118), the actuator 70 further includes a slider 132 extending between the clamp and a detent 134 carried at the end of the slider opposite the clamp, and including a shoulder 136. The direction of movement of the slider 132 is defined by a linear guide 138 formed as part of an inner roof 140 disposed adjacent the top 28 of the toy automobile. By virtue of the cooperation between clamp 124 and flange 118, the linear motion of the slider 132 (as defined by the guide 138) corresponds to rotational pivoting motion of the carriage 80 and hence movement of the wheel 72 between its retracted and projected positions.

In order to secure the wheel 72 in its retracted position, the slider 132 and associated elements combine to form a latch mechanism of a releasable character. Moving the slider against the bias of spring 120, the operator can move the detent 132 into registry with an aperture 144 in the top 28 of the toy automobile. (This configuration is depicted in FIG. 6.) At this point, the wheel 72 is disposed in the position shown in FIGS. 1 and 11 wherein it is withdrawn from the surface 34. In order to provide a restraint upon the elements in this position against the bias of spring 120, the toy figure 32 is formed to include a protrusion 146 extending from its base 148. This can best be seen in FIG. 13. When the figure is disposed upon the body 22 as illustrated in FIG. 1, the protrusion 146 extends through both aperture 144 and detent 134; and by virtue of its physical presence therebetween, the protrusion forms a wedge against shoulder 136 and prevents movement of the slider 132. As a result, when the toy figure 32 is placed in position atop the toy automobile with the protrusion 146 passing through aperture 144 and detent 134, the actuator is restrained from movement, and the toy automobile may be operated without the involvement of the skid inducing means. (See particularly FIG. 8 which illustrates in cross-section the relationship between the protrusion, detent and aperture.)

The particular characteristic of the toy automobile, according to the present invention, which results in wheel 72 being in engagement with surface 34 in one position, while it is withdrawn from such engagement in a second position is the spatial relationship between drive wheel 30 the rear skid 62 and the length of bracket 76 in conjunction with the disposition of carriage 80 with respect to the chassis 58. In the retracted position of wheel 72, the rear skid 62 will engage surface 34 and, together with drive wheel 30, will support the weight of the body 22 in equilibrium. When the wheel 72 is pivoted into its projected position, the length of the bracket and the radius of the wheel 72 is such that the wheel extends beyond the skid 62 at the rear of the chassis (as can be seen in FIG. 5). In this disposition, wheel 72 combines with the front skid 62 to support the car in equilibrium.

To provide alternative means for permitting operation of the toy automobile independently of actuation of the skid inducing means, the present invention also provides a manual disabler for overriding the actuator 70 and preventing the rotation of carriage 80. More particularly, the disabler includes a lock arm 152 which projects through a slot in the windshield 153 (see FIG. 1) so as to be accessible by the user. The disabler is shown with particularity in FIGS. 6, 7 and 9, to include a pin 154 at the end opposite the lock arm portion projecting through the windshield. This pin is held captively within a detent 160 formed within a boss 162 in order to provide a pivoting motion for the lock arm. A functional portion of the lock arm is an angular shoulder 164 which is adapted to cooperate with a mating shoulder 166 (see FIG. 7) carried by the slider 132. In the normal operation of the skid inducing means, the lock arm 152 is pivoted so that the shoulder 164 is withdrawn from the path of shoulder 166. If it is desired that the skid inducing means be prevented from operation regardless of the presence or absence of the toy figure 32, the disabler can be engaged by pivoting lock arm 152 about pin 154 to bring shoulder 164 into the path of shoulder 166. In this orientation, as illustrated in FIG. 6, shoulder 164 effectively blocks the path of shoulder 166 capturing this shoulder and preventing movement of the slider 132 in the direction urged by the bias of spring 120.

The operation of the toy automobile of the present invention and the use of the skid inducing means will now be described. The user prepares the toy automobile for operation by manually pivoting wheel 72 upwards into its retracted position thereby increasing the tension of spring 120 upon carriage 80. Simultaneously, the slider 132 slides toward aperture 144 until the detent 134 is in registry therewith. At this point, the user inserts the protrusion 146 of the toy figure through both the aperture and the detent (as shown in FIG. 8), and the toy automobile is ready for use. The drive wheel 30 is rotated by the user as described hereinabove, and the toy automobile is then placed on surface 34 and released. The kinetic energy of drive wheel 30 is transferred to surface 34 in order to drive the toy automobile forward. The automobile may proceed across surface 34 until the kinetic energy of the wheel is expended and the automobile comes to a stop.

An alternative operation involves directing the automobile across the inclined surface 40 of ramp 38 and beneath the overhead rail 44. In this mode of operation, the hook 46 carried by the toy figure engages the rail 44 and withdraws the figure from its position atop the toy automobile (see FIG. 2). This action withdraws protrusion 146 from detent 144 permitting the slider 132 to move in response to the tension provided by spring 120. Consequently, the carriage 80 rotates and wheel 72 advances from its retracted to its projected position.

As indicated hereinabove, the wheel 72 is positionable in a plurality of angular orientations with respect to the carriage 80 and hence with respect to the direction of motion (indicated by arrow 64 in FIGS. 1 and 3) in which the automobile 20 is driven by drive wheel 30. The disposition of the wheel 72 at some angular orientation with respect to the drive wheel 30 will have the effect of throwing the car into an apparent skid when the wheel 72 is placed into its projected position and engages surface 34. During its engagement with surface 34, wheel 30 will have imparted to the toy automobile a forward motion, while wheel 72 will thereafter impose a component of force on the rear of the automobile at an angle from direction 64, the angle corresponding to the angle at which wheel 72 is preset by the user. As a result, the toy car will be deflected from direction 64 and thrown into an apparent skid, the degree of skidding simulated being a function of the angle at which the wheel 72 is positioned.

More specifically, if wheel 72 is positioned at a small angle from direction 64, the rear of the automobile will be gradually swung outward from direction 64 upon engagement of wheel 72 with surface 34. On the other hand, if the wheel 72 is set at a large angle from direction 64, this swinging of the rear end of the automobile will be rapid. This latter situation simulates a more severe skid than the former.

Referring now to FIGS. 4, 5 and 11, a further feature of the present invention will be disclosed. As already indicated, the toy figure 32 includes a base 148 and a protrusion 146. The toy automobile includes an aperture 180 disposed along its forward portion between the front fenders thereof. This aperture is adapted to receive the protrusion 146 and thereby support the toy figure with respect to the body 22. In this fashion, the toy automobile may be operated with the toy figure 32 carried between the fenders of the car.

As indicated above, one of the popular stunts performed by daredevil automobile drivers and riders is the catapulting of a person from a portion of the automobile. To simulate this action, the present invention provides a bumper combination designated generally by the numeral 182 at the front of the body 22. A part of this bumper is an extension 184 which extends forwardly beyond any other projection associated with the body 22. As a result, when the automobile engages an external object disposed forwardly of the body 22, extension 184 is the first portion of the body to make contact therewith.

The extension 184 is formed as part of a pivotable rocker arm 186 which is pivoted at a point 188 with respect to a flange 190 carried by the chassis 58 of the toy automobile. The rocker arm 186 also includes an elongated rod 192 proximate the end thereof opposite the extension 184. The rod is defined in size and disposed such that it is positioned proximate aperture 180 in a first of position, and it projects through the aperture in a second position. The distribution of weight of the rocker arm is such that rod 192 is normally disposed in the first of said positions. When extension 184 is engaged externally of the body 22 and forced rearwardly with respect to the body, the pivoting of the rocker arm thrusts the rod into the second of said positions.

FIG. 13 illustrates the operation of the present invention as it pertains to this latter described characteristic. The toy figure 32 having been mounted with its protrusion 146 within aperture 180 (as illustrated in FIG. 5), the automobile is directed into engagement with an external object such as wall 202. The extension 184 engages the wall 202 and causes the rocker arm 186 to pivot thereby thrusting rod 192 through aperture 180 and into engagement with the lowermost portion of the protrusion 146. This operation causes the toy figure to rebound from the rod 192 with the result that it is catapulted from its position atop the fenders of the toy automobile.

This action gives the user a wide choice of operating modes for the toy car, and can provide significant useful play experience.

The present invention has thus been described in a preferred embodiment thereof. Clearly, this embodiment does not constitute a limitation of the broad concept of the invention. For example, the skid inducing wheel 72 could be disposed at such a distance from the chassis of the car in its extended position that both it and the drive wheel 30 engage the surface 34 contemporaneously. This would provide a modified skidding action for the toy car. Simularly, a skid inducing member other than a rotatable wheel could be provided. Structural modifications can be made to the operating elements of the present invention; for example, a torsional or compression spring could be provided in the place of tension spring 120, and the carriage and bracket mechanisms could be substantially modified without departing from the conceptual scope of the present invention. The bellcrank 186 and associated elements could be replaced by a spring-loaded mechanism performing the same function. Therefore, the present invention is not intended to be limited to the embodiment depicted and described, but is to be given its true conceptual breadth.

What is claimed as new and desired to be secured by Letters Patent of the United States is:

1. A toy automobile comprising:

a body having a front and a rear, a top and a bottom, and a longitudinal axis;

a drive wheel supported by the body for engaging a surface to propel the body thereon in a predetermined direction generally parallel to said axis;

a retractable skid-inducing means supported by the body for engaging the surface and deflecting the motion of the body from said direction, the skid-inducing means moveable between a first position remote from the surface and a second position engaging the surface; and actuator means for moving the skid inducing means between said first and second positions.

2. The toy automobile of claim 1 wherein said actuator means includes a biassing means for urging the skid-inducing means toward said second position.

3. The toy automobile of claim 2 wherein said actuator means further includes releasable latch means for securing said skid-inducing means in said first position, the latch means adapted to cooperate with a toy figure supportable by the body.

4. The toy automobile of claim 3 wherein removal of said figure from said body releases said latch means and permits said biassing means to move said skid-inducing means from said first position to said second position.

5. The toy automobile of claim 4 wherein said toy figure includes a protrusion and said latch means includes detent means for receiving said protrusion.

6. The toy automobile of claim 1 wherein said skid inducing means includes a surface-contacting element carried by and pivotable with a bracket, the surface-contacting element selectively disposable in a plurality of angles with respect to said direction of movement of said body; the bracket supported by a carriage by the body, the carriage pivotable through an arc.

7. The toy automobile of claim 6 wherein the skid-inducing means causes the body to be deflected from its direction of movement by an amount corresponding to the angle in which the surface-contacting element is disposed.

8. The toy automobile of claim 6 wherein said surface-contacting element includes a rotatable second wheel carried proximate one end of said bracket, the other end of said bracket cooperating with said carriage.

9. The toy automobile of claim 8 wherein said carriage is pivotable through said arc, at one point of which said second wheel engages said surface and at a second point of which said second wheel is withdrawn from said surface.

10. The toy automobile of claim 8 wherein said carriage includes a spring biassing said carriage toward said first point.

11. The toy automobile of claim 5 wherein the latch means includes a slider means, the slider means including a first shoulder for engaging said protrusion of said toy figure, a second shoulder for engaging said carriage and a third shoulder.

12. The toy automobile of claim 5 further including manually operable disabler means disposable within the path of movement of said slider means to prevent operation of said biassing means regardless of the absence of said toy figure.

13. The toy automobile of claim 12 wherein said disabler means includes a fourth shoulder for engaging said third shoulder of said slider means.

* * * * *